US005573577A

United States Patent [19]

Joannou

[11] Patent Number: 5,573,577

[45] Date of Patent: Nov. 12, 1996

[54] IONIZING AND POLARIZING ELECTRONIC AIR FILTER

[76] Inventor: Constantinos J. Joannou, 49 Mill Street, Unit 4, Carleton Place, Ontario, Canada K7C 1T6

[21] Appl. No.: 373,072

[22] Filed: Jan. 17, 1995

[51] Int. Cl.[6] ..... B03C 3/41

[52] U.S. Cl. ..... 96/66; 96/96

[58] Field of Search ..... 96/96, 97, 66; 95/78

[56] References Cited

U.S. PATENT DOCUMENTS

| | | | |
|---|---|---|---|
| 913,941 | 3/1909 | Blake | 96/96 |
| 945,917 | 1/1910 | Cottrell | 96/97 X |
| 1,428,839 | 9/1922 | Fortescue | 96/96 X |
| 2,593,869 | 4/1952 | Fruth | 96/96 X |
| 4,549,887 | 10/1985 | Joannou | 96/58 |
| 4,828,586 | 5/1989 | Joannou | 96/66 |
| 5,143,524 | 9/1992 | Inculet et al. | 96/66 X |
| 5,330,559 | 7/1994 | Cheney et al. | 95/78 X |
| 5,403,383 | 4/1995 | Jaisinghani | 96/96 X |
| 5,474,599 | 12/1995 | Cheney et al. | 95/78 X |

*Primary Examiner*—Richard L. Chiesa

[57] ABSTRACT

A high efficiency electronic air filter is disclosed in which pads of dielectric fibres are sandwiched between electrically charged, ionizing elements and grounded screens. The ionizing elements charge the dust particles passing through the filter and at the same time polarize the fibrous pads. In this way, the charged particles are attracted and collected on the fibrous pads with improved efficiency.

13 Claims, 4 Drawing Sheets

IONIZING AND POLARIZING ELECTRONIC AIR FILTER

FIELD OF THE INVENTION

This invention relates to gas and air filtration systems. In particular, it relates to the removal of fine particulates like dust from gaseous flows.

BACKGROUND OF THE INVENTION

In the previous art, various combinations of ionizing and dust collecting elements have been used to produce high efficiency electronic air filters. One classic example is the standard precipitator type electronic air filter in which ionizing fine wires of about 0.005 inches diameter, charged at about 7 kilovolts are placed between grounded plates to generate a corona and charge the dust particles passing therethrough. Further down the air flow path, alternating charged and grounded plates collect the charged particles of dust.

Precipitating filters, while highly efficient, produce large number of ions and generate ozone. They also consume distinct quantities of current at high voltage, thereby requiring substantial power supplies.

Another type of electronic air filter is the non-ionizing, polarized dielectric media type. This is not as efficient as the precipitator type but it is cheaper and easier to maintain. This filter uses filament pads of non-conducting, dielectric material sandwiched between charged and grounded screens which produce electrostatic fields to polarize these pads. Any particulates passing through the filter also get polarized and they are attracted and collected by the packed filaments within the pads. This type of system produces very few ions, if any at all, no ozone and consumes virtually no current. The power supply required is thus of a low power type.

Prior art patents based on the polarization principle by the present inventor are U.S. No. 4,549,887 and No. 4,828,586. The first patent describes a pair of outer hinged screens for enclosing a pair of glass fibre pads with a central grid therebetween. The central grid, made of coarse wire mesh that is on the order of 0.020 inches in diameter, is charged to around 7000 volts and the outer screens are grounded. This combination does not generate ions significantly. The spacing between the charged screens is between one and two inches, producing a steep electric field gradient. This field gradient polarizes the non-conducting glass fibres rendering them active in trapping dust particles, and more effective than non-polarized pads.

An advantage of this type of filter is that the accumulated dust is readily removed by exchanging the glass fibre pads for fresh pads.

Both of the above designs have disadvantages. The precipitator type, although it is very efficient when clean, because of the limited surface of the collecting plates, its efficiency drops as the filter loads up with dust. The filter's loading capacity, especially for the larger particles, is very low. Maintenance of the precipitator type filters is very tedious especially in industrial and commercial applications. Also they are expensive both in original investment and operating costs since they have very elaborate construction and have large high voltage power supplies that consume anywhere from 80 to 150 watts.

The polarizing filters do not have the disadvantages of the precipitator filters but they lack efficiency.

In view of the foregoing, it is the object of my present invention to provide an electronic filter which is highly efficient, easy to maintain and inexpensive.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention herein is based on combining features of polarization and ionization in one simple design. Generally, the embodiment of my present invention consists of fibrous pads of dielectric material placed between a charged active grid and a grounded screen similar to as described in my previous patents. The charged grid is, however, made in such a way that it provides a degree of ionization within the air flow passing through the filter. This may be achieved either by providing fine wires which produce ions because of the high potential gradient that such wires form; or by providing an array of fine, sharp points carried by conductive filaments which do the same thing. Besides producing ions, the ionizing grid produces an electrostatic field between the grid itself and the grounded screen which polarizes the fibrous pad which is located therebetween. In this way, the filter operates both in the polarizing mode and the ionizing mode at the same time.

The foregoing summarizes the principal features of the invention and some of its optional aspects. The invention may be further understood by the description of the preferred embodiments, in conjunction with the drawings, which now follow.

Several embodiments of the present invention will hereinafter be described by way of example only and with reference to the following drawings herein.

DESCRIPTION OF THE PREFERRED EMBODIMENT

A convenient way of providing an ionizing grid is to render a cord of composite filaments of short fibres, such as cotton, conductive. Each of the short fibres may be of a small enough diameter to effect ionization. Alternately, or additionally, each fibre may provide an end that has around it a higher field gradient than the fibre itself thereby creating ions.

This grid of broken fibre lengths joined in a conductive string may be prepared by applying a conductive material, such as a high carbon ink, to the fibre. A conductive path may similarly be deposited onto a fabric woven with similar filaments.

In this manner, a source of ionization is provided that is substantially less expensive than a system based on use of a grid of fine wires. Nevertheless, such wires may be employed as the ionizing source for the invention.

Figure 1:
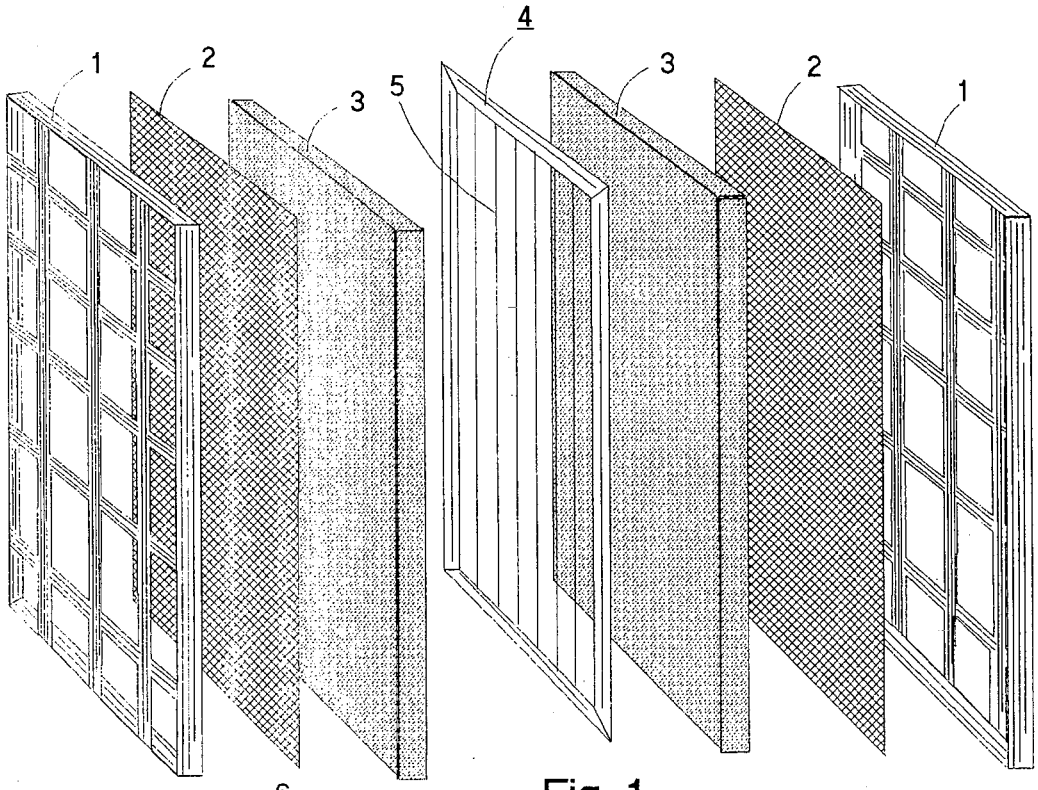
FIG. 1 shows an exploded perspective view of the compounds of a basic filter with fine wires as the ionizing grid.

Referring to the drawings, FIG. 1 shows the assembly of components for a cartridge filter according to the invention. Two outside perforated retainers form the outside case of the filter. Two outside conducting polarizing screens 2 are mounted within the frames 1. Two fibrous pads 3, preferably made of glass fibres, are placed centrally between the polarizing screens 2. Located centrally between the pads 3 is the ionizing grid 4. Ionizing grid 4 comprises fine wires 5 which ionize the surrounding air when high voltage is applied to them by virtue of a high potential gradient which is present around the wires. The diameter of wires 5 is preferably between 0.001 and 0.007 inches causing ionization at a potential of 7000 volts. Their spacing is between 0.5 inches and 2 inches. The spacing between the grid 4 and screens 3 is between one half and one inches to produce the polarizing field gradient.

Figure 2:
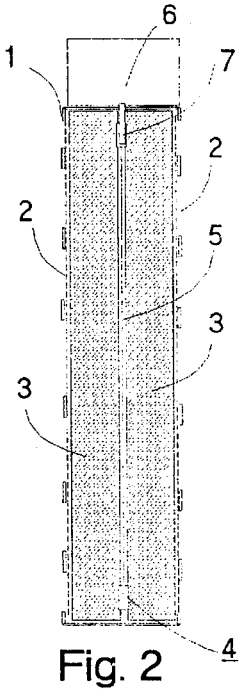
FIG. 2 shows the construction of the assembled filter of FIG. 1 in cross-sectional view.

FIG. 2 shows a cross-sectional view of the cartridge filter shown in FIG. 1 when assembled. A high voltage power supply 6 connects to ionizing grid 4 via probe 7. Power supply 6 and probe 7 are preferably detachable. (See U.S. Pat. No. 4,828,586).

Figure 3:
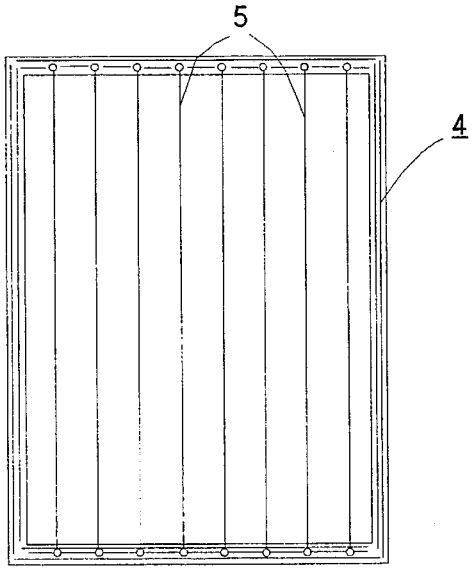
FIG. 3 shows a central grid composed of fine, ionizing wires.

FIG. 3 shows a detail of construction of central grid 4 which comprises fine ionizing wires 5.

Operation of the filter is as follows: High voltage (about 5 to 10 KV) is applied to central grid 4 which, by virtue of its fine wires, ionizes the air and dust particles in the space between grid 4 and outside screens 2. At the same time, because of the high voltage applied to grid 4, an electrostatic field is also created between grid 4 and screens 2 and thus polarizes the non-conducting, dielectric fibrous pads 3. Dust particles or any particulate matter entering the filter become charged due to ionization and are attracted and collected by the polarized fibrous pads 3. This double action of ionization and polarization makes for a filter of improved efficiency.

Figure 4:
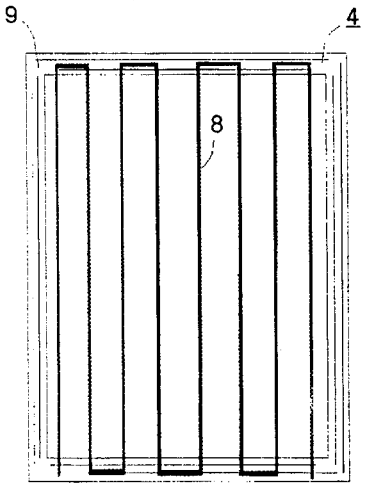
FIGS. 4, 5 and 6 show alternate arrangements for the ionizing grid.

FIG. 4 shows an alternate construction of the central grid 4. A length of fibrous string 8, such as one made of cotton having broken fibre ends is treated with a conducting solution, such as colloidal graphite, to render it conducting. String 8 is attached to a conducting frame 9. Fibrous string 8, because of its composition of fine fibres with multiple ends and, because it is rendered conducting, functions the same way as fine wires in ionizing dust particles.

Figure 5:
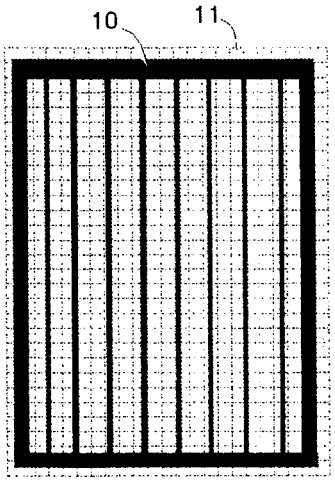

FIG. 5 shows another alternate construction where an ionizing grid 10 is formed by depositing conducting paint or colloidal graphite on a sheet of gauze 11. Gauze 11, because of its composition of fine fibres and because it is rendered conducting, functions the same way as fine wires 5 in effecting ionization.

Figure 6:
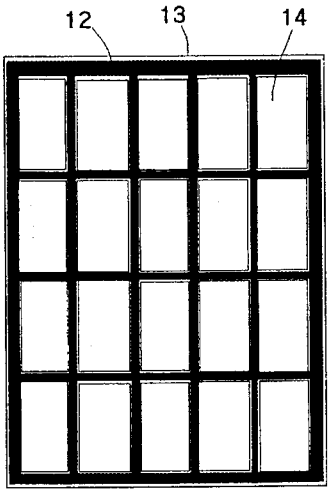

FIG. 6 shows another alternate construction for the central grid. In this case, a grid 12 is painted with conducting paint or colloidal graphite on coarse, fibrous paper 13. This paper 13 is perforated with perforations 14 to allow air to pass through. This arrangement also functions the same way as grid 4 in effecting ionization of dust particles because the coarse fibrous paper also has fine fibers which act in the same manner as the fibers in string 8 of FIG. 4.

Figure 7:
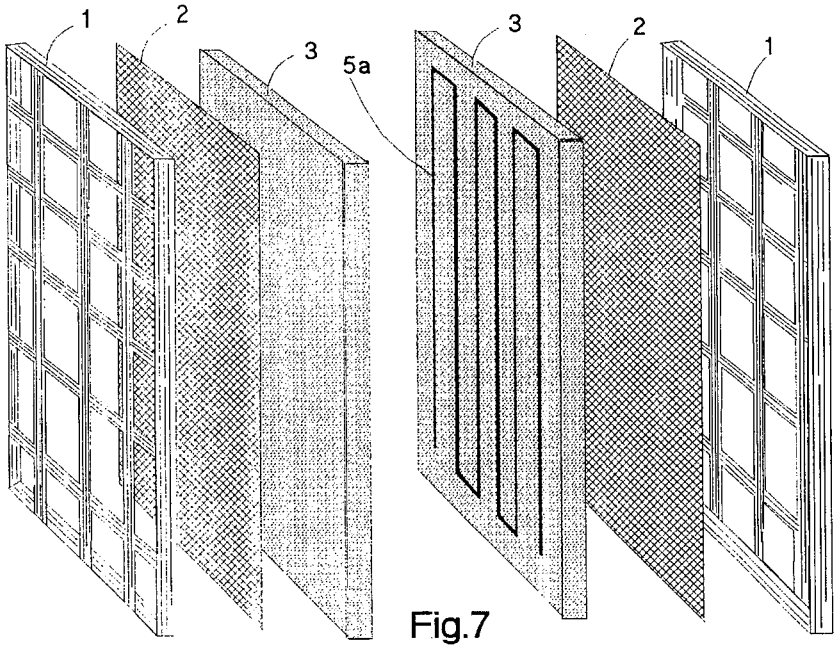
FIG. 7 shows an exploded perspective view of a pad where the ionizing grid is attached to one of the fibrous pads.

FIG. 7 shows an alternate construction which is similar to the filter shown in FIGS. 1 and 2. In this case, the ionizing grid element consists of a fibrous conductive string **5*a* composed of fine filaments attached to one of the fibrous filter trapping pads 3. Fibrous string is again made conductive by coating it with conductive material like colloidal graphite. Conductive string 5*a* is connected to a high voltage power supply in a similar manner as shown in FIG. 2**. Operation of this filter is as described above.

Figure 8:
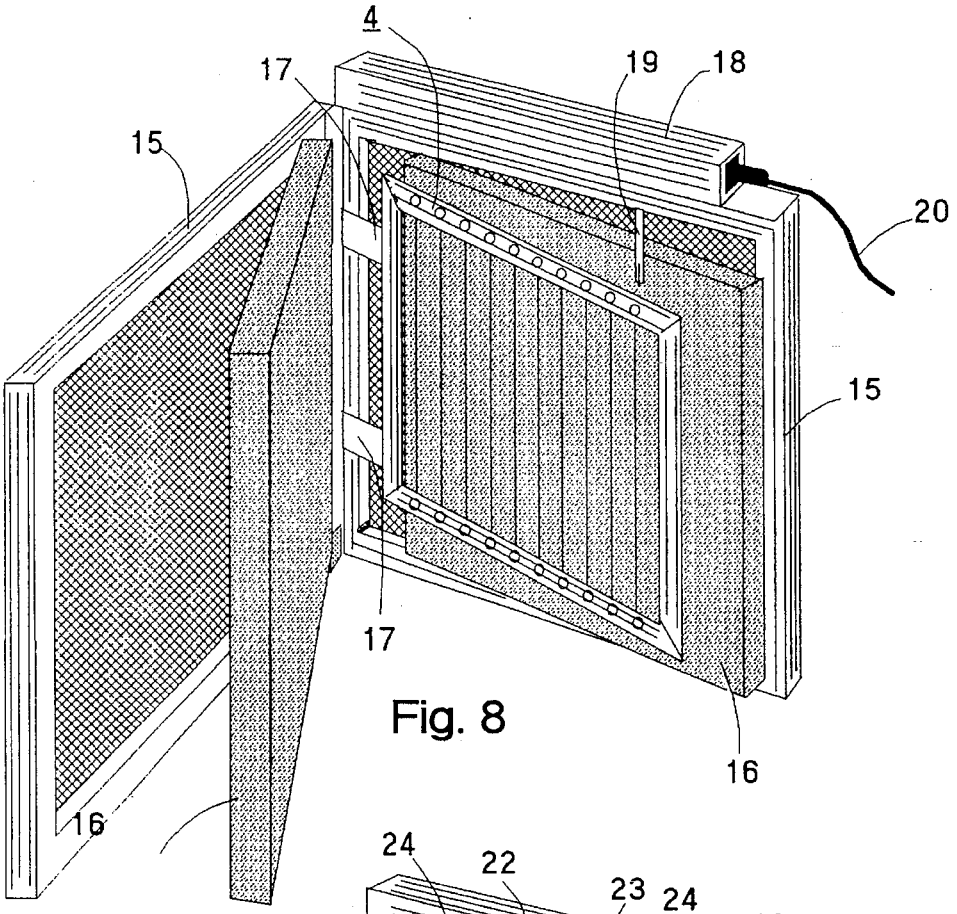
FIG. 8 shows a perspective view of a hinged filter arrangement where the two outside screens are hinged together and the central ionizing grid is hinged with insulating hinges. Power to the central grid is supplied by a high voltage power supply attached to one of the outside screen frames.

FIG. 8 shows a filter arrangement where two screens with frames 15 are hinged together to form the outside of a filter. (See also U.S. Pat. No. 4,549,883). Fibrous pads 16 are positioned on either side of central grid 4. Grid 4 is attached to its own one of frames 15 by insulating hinges 17. A high voltage power supply 18 connects to grid 4 via electrode 19 when the filter is closed. A cord 20 is connected to a low voltage power supply for supplying power to high voltage power supply 18. Operation of this filter is the same as described above for the cartridge filter shown in FIGS. 1 and 2.

Figure 9:
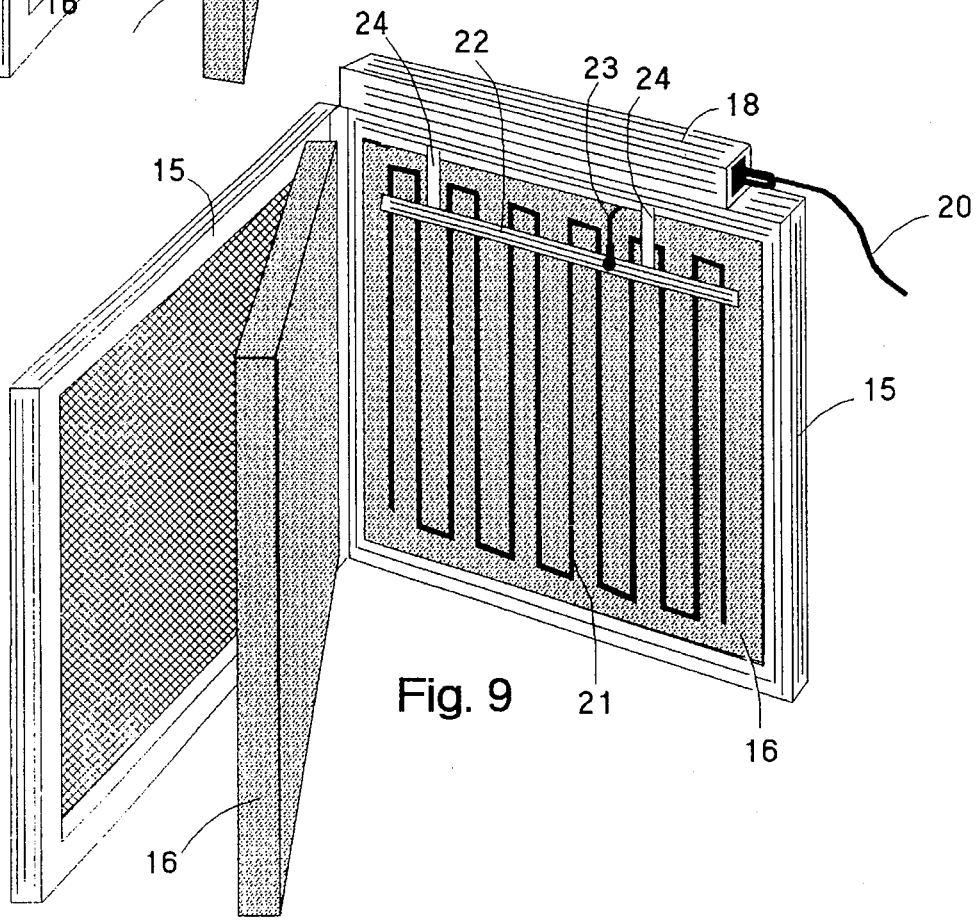
FIG. 9 is a similar figure to FIG. 8 except that the central ionizing grid is attached to one of the fibrous pads. High voltage to the grid is supplied via a conducting strip connected to a high voltage power supply.

FIG. 9 shows a similar arrangement as that of FIG. 8 except that in this case a conducting grid 21 is formed on one side of fibrous pad 10. Grid 21 is made by painting conducting elements directly on the fibrous pad.

Grid 21 is connected to power supply 18 via conducting strip 22 and wire 23. Strip 22 is attached to one of frames 15 by insulating hinges 24. Grid 21 functions the same way as grid 4 in the arrangement of FIGS. 1 and 2.

It is possible to construct any of the above mentioned arrangements using any of the different ionizing grid constructions described herein.

Figure 10:
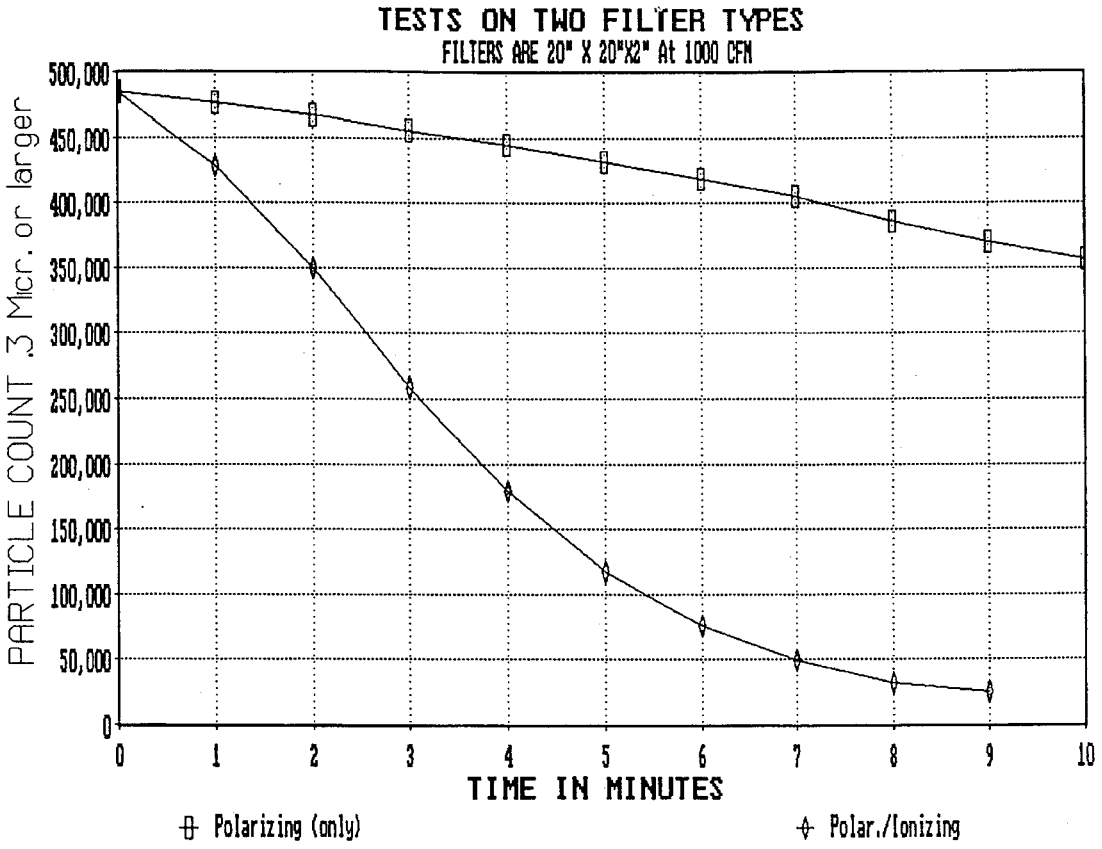
FIG. 10 is a graph showing the removal of particles over time from a room using respectively a prior art polarized filter, a prior art precipitating ionizing filter and a filter according to the invention.

FIG. 10 shows the results of comparative tests made on a 20"×20"×2" cartridge type polarizing filter and the same filter with conductive fibrous strings. The high voltage used was 10 KV on the cartridge filters.

The tests were made by generating smoke in a sealed 570 cubic feet room. A ventilator was used to circulate air through the filters and the level of contamination was measured using a CLIMET INNOVATION 500 particle counter. The particle counter is capable of counting different particle sizes in the air as is drawn through the tube into the instrument. The counts used were for particles down to a 0.3 micron size, which is the most difficult particle size to capture, and the most numerous. The instrument was set to count the particles in 0.2 cubic feet of air every minute. All tests were made with 1000 cubic feet per minute (CFM) of air circulating through the filters as measured by an EBTRON air velocity meter.

The results show that by using ionization as well as polarization, (middle curve) the efficiency of filter improves as compared to using only polarization. Precipitators may be more efficient but it uses much more energy to operate. They have much less loading capacity and are far more expensive to operate. Precipitator require between 80 to 100 watts of power to operate while both the polarized media and the new polarized media/ionization type filters use only about 1.5 watts to operate. In both of the latter cases, the trapping pads, once coated with dust may be readily removed and exchanged for fresh, clean pads.

While two fibrous pads have been shown throughout as embracing the high voltage grid, only one is required. Two pads are preferred to cover the high voltage grid and prevent inadvertent contact.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. An ionizing apparatus comprising an air filter having:

(a) a conducting screen;

(b) a fibrous pad of non-conducting, dielectric material having first and second sides and positioned with the first of its sides adjacent said screen;

(c) an electrical coupling means for receiving an electric potential from a high voltage source; and (d) a polarizing and ionizing element located adjacent to and in contact with the second side of the fibrous pad, opposite the screen, said polarizing and ionizing element comprising an electrically conductive filament having multiple, exposed filament ends distributed along its length for providing a high potential gradient to ionize particle components of a gas passing therethrough, said conducting screen and said polarizing and ionizing element being connected to the electrical coupling means to produce said high potential gradient and to polarize the fibrous pad to trap said ionized particulate components when supplied with charge from a high voltage source through said electrical coupling means.

2. An ionizing apparatus as in claim 1 in which said filament comprises one or more lengths of fibrous string rendered conductive by a conductive coating present thereon.

3. An ionizing apparatus as in claim 2 wherein said one or more lengths of string are attached to said fibrous pad.

4. An ionizing apparatus as in claim 1 in which said filament comprises portions of the fibers of said fibrous pad which have a conductive coating deposited thereon.

5. An ionizing apparatus as in claim 1 in combination with a voltage power supply which provides a potential between the ionizing element and the conducting screen of between 5,000 and 10,000 volts.

6. An ionizing apparatus as in claim 1 wherein said pad is a first fibrous pad, said filter having a second, non-conducting, fibrous pad of dielectric material positioned adjacent to the ionizing element opposite said first fibrous pad, and wherein said conducting screen is a first conducting screen and a second conducting screen, which is electrically connected to the first conducting screen, is positioned adjacent to the second fibrous pad on the side opposite to said polarizing and ionizing element.

7. An ionizing apparatus as in claim 1 in which said filament is provided by a porous, fibrous fabric comprising a deposit of a conductive material present on the surface of the fibers of said fabric to render the coated portion of the fabric conductive.

8. An ionizing apparatus as in claim 1 in which said filament is provided by a sheet of porous fibrous, paper upon which conducting elements are formed by a deposit of conductive material thereon.

9. A filter cartridge for use in an ionizing air filter comprising:

(a) first and second pads of fibrous, non-conducting, dielectric material each having inner and outer sides, said inner sides being juxtaposed to each other;

(b) a conductive path provided with the first of said pads on the inner side of said pad; and (c) electrical coupling means attached to said conductive path for receiving an electrical potential from a high voltage source, the conductive path comprising a conductive filament having multiple, exposed filament ends distributed along its length to form, when electrically charged to an ionizing potential, an electrical gradient that produces ionization in air that surrounds said filament.

10. A filter cartridge as in claim 9 wherein the conductive filament is in the form of one or more lengths of fibrous string attached to said first pad, said string being rendered conductive by a conductive coating present thereon.

11. A filter cartridge as in claim 9 wherein the first pad carries a porous, fibrous fabric, the conductive filament being provided by portions of said fabric that have been rendered conductive by a conductive coating present thereon.

12. A filter cartridge as in claim 9 wherein the conductive filament is a filament of the first pad that has been rendered conductive by a conductive coating present thereon.

13. A filter cartridge as in claim 9 wherein the first pad carries a sheet of fibrous paper upon which said conductive filament is formed by a deposit of conductive material thereon.

* * * * *